US008778140B2

(12) United States Patent
Cheng et al.

(10) Patent No.: US 8,778,140 B2
(45) Date of Patent: Jul. 15, 2014

(54) PREFLOCCULATION OF FILLERS USED IN PAPERMAKING

(71) Applicants: Weiguo Cheng, Naperville, IL (US); Katherine M Broadus, Aurora, IL (US); Dorota Smoron, Hoffman Estates, IL (US); Shawnee M Wilson, Downers Gove, IL (US)

(72) Inventors: Weiguo Cheng, Naperville, IL (US); Katherine M Broadus, Aurora, IL (US); Dorota Smoron, Hoffman Estates, IL (US); Shawnee M Wilson, Downers Gove, IL (US)

(73) Assignee: Nalco Company, Naperville, IL (US)

( * ) Notice: Subject to any disclaimer, the term of this patent is extended or adjusted under 35 U.S.C. 154(b) by 0 days.

(21) Appl. No.: 13/665,963

(22) Filed: Nov. 1, 2012

(65) Prior Publication Data

US 2013/0059949 A1 Mar. 7, 2013

Related U.S. Application Data

(63) Continuation-in-part of application No. 11/854,044, filed on Sep. 12, 2007, now Pat. No. 8,172,983.

(51) Int. Cl.

| | |
|---|---|
| ***D21H 17/68*** | (2006.01) |
| ***D21H 17/69*** | (2006.01) |
| ***D21H 23/24*** | (2006.01) |
| ***C09C 3/00*** | (2006.01) |
| ***C09C 3/10*** | (2006.01) |
| ***C09C 1/02*** | (2006.01) |
| ***C09C 1/28*** | (2006.01) |
| ***C09C 1/42*** | (2006.01) |

(52) U.S. Cl.

USPC ..... 162/168.3; 162/158; 162/164.6; 162/181.6; 162/181.7; 162/181.8; 162/185; 106/400; 106/416; 106/465; 106/468; 106/487; 106/499

(58) Field of Classification Search

USPC ..... 162/162, 164.1, 164.6, 166, 158, 185, 162/168.1–168.3, 181.1–181.8; 106/400, 106/416, 448, 461, 465, 468, 469, 499, 106/481–483, 486, 487

See application file for complete search history.

(56) References Cited

U.S. PATENT DOCUMENTS

| | | | | |
|---|---|---|---|---|
| 2,037,525 | A | | 4/1936 | Marantz |
| 2,113,034 | A | | 4/1938 | Rowland et al. |
| 2,328,537 | A | | 9/1943 | Felton et al. |
| 2,805,966 | A | | 9/1957 | Etheridge |
| 4,305,826 | A | * | 12/1981 | Moses ..... 210/687 |
| 4,799,964 | A | | 1/1989 | Harvey et al. |
| 4,871,251 | A | | 10/1989 | Preikschat |
| 4,925,530 | A | * | 5/1990 | Sinclair et al. ..... 162/164.1 |
| 5,017,268 | A | * | 5/1991 | Clitherow et al. ..... 162/146 |
| 5,620,510 | A | | 4/1997 | Mentzer et al. |
| 5,759,346 | A | * | 6/1998 | Vinson ..... 162/123 |
| 6,190,663 | B1 | | 2/2001 | Hawkins et al. |
| 6,524,439 | B2 | | 2/2003 | Chen et al. |
| 6,696,067 | B2 | * | 2/2004 | Brandt et al. ..... 424/401 |
| 7,951,265 | B2 | * | 5/2011 | Esser et al. ..... 162/166 |
| 8,088,213 | B2 | | 1/2012 | Cheng et al. |
| 8,172,983 | B2 | | 5/2012 | Cheng et al. |
| 8,298,508 | B2 | | 10/2012 | Wang et al. |
| 2003/0188738 | A1 | * | 10/2003 | Laleg ..... 127/32 |
| 2009/0267258 | A1 | | 10/2009 | Cheng et al. |
| 2010/0078138 | A1 | | 4/2010 | Laleg |

FOREIGN PATENT DOCUMENTS

| | | | | |
|---|---|---|---|---|
| EP | 805234 | A2 | * | 11/1997 |
| WO | 9746591 | A1 | | 12/1997 |
| WO | 0059965 | A1 | | 10/2000 |
| WO | 0114274 | A1 | | 3/2001 |

OTHER PUBLICATIONS

Determination of Molecular Weights, by Paul J. Flory, pp. 266-316, Principles of Polymer Chemistry, Cornell University Press, Ithaca, NY, Chapter VII (1953).

Kuboshima, K. "On Functional Fillers for Paper Making", High Perform Paper Soc (Jpn) 1982, 21, 31, 9 pages.

Yan, Z.; Liu, Q.; Deng, Y.; Ragauskas, "Improvement of Paper Strength with Starch Modified Clay", A. Journal of Applied Polymer Science, 97, 44, 2005.

Yoon, S.Y.; Deng, Y. Journal of Colloid and Interface Science 278, 139, 2004—(available via EFS as previously submitted related case reference).

Alfano, J.C., Carter, P.W., and Gerli, A., "Characterization of the Flocculation Dynamics in a Papermaking System by Non-imagine Reflectance Scanning Microscopy (SLM)", Nordic Pulp Paper Res. J., 13(2), 59 (1998).

* cited by examiner

*Primary Examiner* — Dennis Cordray

(74) *Attorney, Agent, or Firm* — Benjamin E. Carlsen

(57) ABSTRACT

A method of preparing a stable dispersion of flocculated filler particles for use in papermaking processes comprises use of microparticle prior to, simultaneous to, and/or after addition of a first flocculating agent to an aqueous dispersion of filler particles, followed by addition of a second flocculating agent to the dispersion and further optional shearing of the resultant filler flocs to the desired particle size resulting in shear resistant filler flocs with a defined and controllable size distribution. In addition, a neutralizing coagulant can be added to the dispersion to partially or completely neutralize the charge of the filler before the microparticle and/or the first flocculating agent is added.

13 Claims, No Drawings

PREFLOCCULATION OF FILLERS USED IN PAPERMAKING

CROSS-REFERENCE TO RELATED APPLICATIONS

This Application is a Continuation-in-part of pending U.S. patent application Ser. No. 13/449,888 filed on Apr. 18, 2012, which in turn is a continuation in part application claiming priority from U.S. patent application Ser. No. 11/854,044 filed on Sep. 12, 2007 and which has issued as U.S. Pat. No. 8,172,983.

STATEMENT REGARDING FEDERALLY SPONSORED RESEARCH OR DEVELOPMENT

Not Applicable.

BACKGROUND OF THE INVENTION

This invention relates to the preflocculation of fillers used in papermaking, particularly, the production of shear resistant filler flocs with a defined and controllable size distribution at high filler solids is disclosed.

Increasing the filler content in printing and writing papers is of great interest for improving product quality as well as reducing raw material and energy costs. However, the substitution of cellulose fibers with fillers like calcium carbonate and clay reduces the strength of the finished sheet. Another problem when the filler content is increased is an increased difficulty of maintaining an even distribution of fillers across the three-dimensional sheet structure. An approach to reduce these negative effects of increasing filler content is to preflocculate fillers prior to their addition to the wet end approach system of the paper machine.

The definition of the term "preflocculation" is the modification of filler particles into agglomerates through treatment with coagulants and/or flocculants prior their flocculation and addition to the paper stock. The flocculation treatment and shear forces of the process determine the size distribution and stability of the flocs prior to addition to the paper stock. The chemical environment and high fluid shear rates present in modern high-speed papermaking require filler flocs to be stable and shear resistant. The floc size distribution provided by a preflocculation treatment should minimize the reduction of sheet strength with increased filler content, minimize the loss of optical efficiency from the filler particles, and minimize negative impacts on sheet uniformity and printability. Furthermore, the entire system must be economically feasible.

Therefore, the combination of high shear stability and sharp particle size distribution is vital to the success of filler preflocculation technology. However, filler flocs formed by a low molecular weight coagulant alone, including commonly used starch, tend to have a relatively small particle size that breaks down under the high shear forces of a paper machine. Filler flocs formed by a single high molecular weight flocculant tend to have a broad particle size distribution that is difficult to control, and the particle size distribution gets worse at higher filler solids levels, primarily due to the poor mixing of viscous flocculant solution into the slurry. Accordingly, there is an ongoing need for improved preflocculation technologies.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

BRIEF SUMMARY OF THE INVENTION

At least one embodiment is directed towards a method of preparing a stable dispersion of flocculated filler particles having a specific particle size distribution for use in papermaking processes. The method comprises the steps of: a) providing an aqueous dispersion of filler particles; b) adding a first flocculating agent to the dispersion in an amount sufficient to mix uniformly in the dispersion without causing significant flocculation of the filler particles, and the first flocculating agent being amphoteric; c) adding a microparticle to the dispersion in an amount insufficient cause significant flocculation of the filler particles before, simultaneous to, and/or after adding the first flocculating agent, and prior to adding a second flocculating agent; d) adding the second flocculating agent to the dispersion in an amount sufficient to initiate flocculation of the filler particles in the presence of the first flocculating agent wherein the second flocculating agent has opposite charge to the net charge of the first amphoteric flocculating agent; e) shearing the flocculated dispersion to provide a dispersion of filler flocs having the desired particle size; and f) flocculating the filler particles prior to adding them to a paper stock and wherein no paper stock is present during the flocculation.

The filler flocs may have a median particle size of 10-100 μm. The filler may be selected from the group consisting of precipitated calcium carbonate, ground calcium carbonate, kaolin clay, talc, titanium dioxide, alumina trihydrate, barium sulfate and magnesium hydroxide, and mixtures thereof. The first flocculating agent may have a net anionic charge. The second flocculating agent may be cationic, and/or may be selected from the group consisting of copolymers and terpolymers of (meth)acrylamide with dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate, methyl chloride or benzyl chloride, and mixtures thereof. The second flocculating agent may be acrylamide-dimethylaminoethyl acrylate methyl chloride quaternary copolymer having a cationic charge of 10-50 mole percent and a RSV of at least 15 dL/g and/or may be a homopolymer of diallyl dimethyl ammonium chloride having an RSV of 0.1-2 dL/g. The method may further comprise adding one or more microparticles to the flocculated dispersion after addition of the second flocculating agent. The filler may be anionically dispersed and a low molecular weight, cationic coagulant is added to the dispersion to at least partially neutralize its anionic charge prior to the addition of the first flocculating agent or microparticle. Swollen starch may also be added to the dispersion of filler particles. The swollen starch may be cationic, anionic, amphoteric or noionic and/or may be a swollen-starch-latex composition. The microparticle may be one item selected from the list consisting of: siliceous materials, silica based particles, silica microgels, colloidal silica, silica sols, silica gels, polysilicates, cationic silica, aluminosilicates, polyaluminosilicates, borosilicates, polyborosilicates, zeolites, and synthetic or naturally occurring swelling clays, anionic polymeric microparticles, cationic polymeric microparticles, amphoteric organic polymeric microparticles, and any combination thereof.

At least one embodiment is directed towards a paper product incorporating the filler flocs prepared as described herein.

DETAILED DESCRIPTION OF THE INVENTION

The following definitions are provided to determine how terms used in this application, and in particular how the claims, are to be construed. The organization of the definitions is for convenience only and is not intended to limit any of the definitions to any particular category. For purposes of this application the definition of these terms is as follows:

"Coagulant" means a composition of matter having a higher charge density and lower molecular weight than a flocculant, which when added to a liquid containing finely divided suspended particles, destabilizes and aggregates the solids through the mechanism of ionic charge neutralization.

"Flocculant" means a composition of matter having a low charge density and a high molecular weight (in excess of 1,000,000) which when added to a liquid containing finely divided suspended particles, destabilizes and aggregates the solids through the mechanism of interparticle bridging.

"Flocculating Agent" means a composition of matter which when added to a liquid destabilizes, and aggregates colloidal and finely divided suspended particles in the liquid, flocculants and coagulants can be flocculating agents.

"GCC" means ground calcium carbonate, which is manufactured by grinding naturally occurring calcium carbonate rock "PCC" means precipitated calcium carbonate which is synthetically produced.

"Microparticle" means a particle of between 0.1 μm and 100 μm in size, it can compose a number of materials including silicon, ceramics, glass, polymers, and metals, because microparticles have a much larger surface-to-volume ratio than similar macroscale sized materials their behavior can be quite different.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the *Kirk-Othmer Encyclopedia of Chemical Technology,* 5th Edition, (2005), (Published by Wiley, John & Sons, Inc.) this definition shall control how the term is to be defined in the claims.

At least one embodiment is directed towards a method of preparing a stable dispersion of flocculated filler particles having a specific particle size distribution for use in a papermaking processes. A first flocculating agent is added to an aqueous dispersion of filler particles in an amount and under conditions such that it mixes uniformly with the dispersion but does not cause any significant flocculation of the filler particles. Either: before, during, or after the addition of the first flocculating agent, a microparticle is added to the dispersion. After both the first flocculating agent and the microparticle have been added a second flocculating agent is added to the dispersion in an amount and under conditions sufficient to initiate flocculation of the filler particles in the presence of the first flocculating agent. In at least one embodiment the types of first and second agents and the methods of their use, and/or addition are according to any and all of the methods and procedures described in U.S. Pat. No. 8,088,213.

Optionally the flocculated dispersion can be sheared to provide a dispersion of filler flocs having an optimal particle size.

While microparticles have previously been used in papermaking processes, their use in this manner is quite novel. In some prior art processes, microparticles were added in the wet end to prevent the loss of material from the fiber-filler mixture. In this invention however the microparticles are added to the dispersion of filler prior to the dispersion coming into contact with the fibers used to make the paper.

This invention is also different than previous microparticle using methods of preparing filler dispersions aiming to have optimal degrees of high shear stability simultaneous to sharp particle size have used microparticles (such as that of US Published Patent Application 2009/0267258). Those previous methods used the microparticles after the second (flocculation initiating) flocculating agent. In this invention the microparticle is added to the dispersion before flocculation is initiated. This is because the invention makes use of a previously unknown property of these microparticles.

Microparticles are known to facilitate flocculation by strongly interacting with the flocculating agents to strengthening the resulting particle agglomeration. Thus it was previously known that they assisted only one (shear strength) of the two prerogatives of concern (shear strength and particle size).

The invention however makes use of the newly discovered fact that microparticles can positively interact with the filler particles in the absence of any flocculation occurring. Without being limited by theory or design it is believed that the microparticles form very hard "anchor sites" on the surface of the filler particles. Because these anchor sites are much harder that the flocculating polymers, they resist bending and more firmly hold polymer agglomerations onto the filler particles than agglomerations anchored in place by flocculating agents. Thus the inventive method uses microparticles to facilitate the other of the two prerogatives, increasing agglomeration size.

In at least one embodiment the microparticles include siliceous materials and polymeric microparticles. Representative siliceous materials include silica based particles, silica microgels, colloidal silica, silica sols, silica gels, polysilicates, cationic silica, aluminosilicates, polyaluminosilicates, borosilicates, polyborosilicates, zeolites, and synthetic or naturally occurring swelling clays. The swelling clays may be bentonite, hectorite, smectite, montmorillonite, nontronite, saponite, sauconite, mormite, attapulgite, and sepiolite. A suitable representative microparticle is product PosiTEK 8699 (produced by Nalco Company, Naperville Ill.).

Polymeric microparticles useful in this invention include anionic, cationic, or amphoteric organic microparticles. These microparticles typically have limited solubility in water, may be crosslinked, and have an unswollen particle size of less than 750 nm.

Anionic organic microparticles include those described in U.S. Pat. No. 6,524,439 and made by hydrolyzing acrylamide polymer microparticles or by polymerizing anionic monomers as (meth)acrylic acid and its salts, 2-acrylamido-2-methylpropane sulfonate, sulfoethyl-(meth)acrylate, vinylsulfonic acid, styrene sulfonic acid, maleic or other dibasic acids or their salts or mixtures thereof. These anionic monomers may also be copolymerized with nonionic monomers such as (meth)acrylamide, N-alkylacrylamides, N,N-dialkylacrylamides, methyl(meth)acrylate, acrylonitrile, N-vinyl methylacetamide, N-vinyl methyl formamide, vinyl acetate, N-vinyl pyrrolidone, and mixtures thereof.

Cationic organic microparticles include those described in U.S. Pat. No. 6,524,439 and made by polymerizing such monomers as diallyldialkylammonium halides, acryloxyalkyltrimethylammonium chloride, (meth)acrylates of dialkylaminoalkyl compounds, and salts and quaternaries thereof and, monomers of N,N-dialkylaminoalkyl(meth) acrylamides, (meth)acrylamidopropyltrimethylammonium chloride and the acid or quaternary salts of N,N-dimethylaminoethylacrylate and the like. These cationic monomers may also be copolymerized with nonionic monomers such as (meth)acrylamide, N-alkylacrylamides, N,N-dialkylacrylamides, methyl(meth)acrylate, acrylonitrile, N-vinyl methylacetamide, N-vinyl methyl formamide, vinyl acetate, N-vinyl pyrrolidone, and mixtures thereof.

Amphoteric organic microparticles are made by polymerizing combinations of at least one of the anionic monomers listed above, at least one of the cationic monomers listed above, and, optionally, at least one of the nonionic monomers listed above.

Polymerization of the monomers in an organic microparticle typically is done in the presence of a polyfunctional crosslinking agent. These crosslinking agents are described in U.S. Pat. No. 6,524,439 as having at least two double bonds, a double bond and a reactive group, or two reactive groups. Examples of these agents are N,N-methylenebis(meth)acrylamide, polyethyleneglycol di(meth)acrylate, N-vinyl acrylamide, divinylbenzene, triallylammonium salts, N-methylallylacrylamide glycidyl(meth)acrylate, acrolein, methylolacrylamide, dialdehydes like glyoxal, diepoxy compounds, and epichlorohydrin.

In an embodiment, the microparticle dose is between 0.2 and 8 lb/ton of filler treated. In an embodiment, the microparticle dose is between 0.5 and 4.0 lb/ton of filler treated. These dosages refer to the active pounds of microparticle per 2000 pounds of dry filler.

In at least one embodiment the method also involves contacting the filler particles with swollen starch. As described in U.S. Pat. Nos. 2,805,966, 2,113,034, 2,328,537, and 5,620,510 when starch slurry is cooked in a steam cooker under controlled temperature (and optionally controlled pH) condition, the starch can absorb large amounts of water without rupturing. The addition of such swollen starches can also increase the size of the filler flocs used in this invention. In at least one embodiment the swollen starch is a cross-linked starch such as one or more of those described in U.S. Pat. No. 8,298,508 and International Patent Application WO/97/46591.

In at least one embodiment the swollen starch added to the filler particles and/or the method of its use is according to any one of the swollen starch-latex compositions and methods described in US Patent Application 2010/0078138.

As an example, the swollen starch-latex composition, in the presence or absence of co-additives, is suitably prepared in batch or jet cookers or by mixing the suspension of starch and latex with hot water. For a given starch, the swelling is done under controlled conditions of temperature, pH, mixing and mixing time, in order to avoid rupture of the swollen starch granules. The composition is rapidly added to the filler suspension, which is then introduced to the paper furnish, at a point prior to or at the headbox of the paper machine. During the drying operation the retained swollen starch granules with filler particles will rupture, thereby liberating amylopectin and amylose macromolecules to bond the solid components of the sheet.

The combination of swollen starch and latex can be used in filler treatments under acid, neutral or alkaline environments. In at least one embodiment the filler is treated with a swollen starch-latex composition, made with or without co-additives, and is then added to paper slurry. The filler particles agglomerate and the agglomerated filler particles adsorb on the surfaces of the fines and fibers causing their rapid flocculation in the furnish.

In at least one embodiment the swollen starch-latex composition is made by adding latex to uncooked starch and is followed by partial cooking at temperatures slightly below the gel point to produce swollen starch.

In at least one embodiment one or more swollen starch compositions (including swollen starch-latex compositions) is added to the filler dispersion before or simultaneous to when the microparticle is added, before or simultaneous to when the first flocculating agent is added, before or simultaneous to when the second flocculating agent is added, after the second flocculating agent is added, and any combination thereof.

The fillers useful in this invention are well known and commercially available. They typically would include any inorganic or organic particle or pigment used to increase the opacity or brightness, increase the smoothness, or reduce the cost of the paper or paperboard sheet. Representative fillers include calcium carbonate, kaolin clay, talc, titanium dioxide, alumina trihydrate, barium sulfate, magnesium hydroxide, and the like. Calcium carbonate includes GCC in a dry or dispersed slurry form, chalk, PCC of any morphology, and PCC in a dispersed slurry form. Some examples of GCC and PCC slurries are provided in co-pending U.S. patent application Ser. No. 12/323,976. The dispersed slurry forms of GCC or PCC are typically produced using polyacrylic acid polymer dispersants or sodium polyphosphate dispersants. Each of these dispersants imparts a significant anionic charge to the calcium carbonate particles. Kaolin clay slurries may also be dispersed using polyacrylic acid polymers or sodium polyphosphate.

In an embodiment, the fillers are selected from calcium carbonate and kaolin clay and combinations thereof.

In an embodiment, the fillers are selected from precipitated calcium carbonate, ground calcium carbonate and kaolin clay, and mixtures thereof.

The first flocculating agent is preferably a cationic polymeric flocculant when used with cationically charged fillers and anionic when used with anionically charged fillers. However, it can be anionic, nonionic, zwitterionic, or amphoteric as long as it will mix uniformly into a high solids slurry without causing significant flocculation.

The definition of "without causing significant flocculation" is no flocculation of the filler in the presence of the first flocculating agent or the formation of flocs which are smaller than those produced upon addition of the second flocculating agent and unstable under conditions of moderate shear. Moderate shear is defined as the shear provided by mixing a 300 ml sample in a 600 ml beaker using an IKA RE 16 stirring motor at 800 rpm with a 5 cm diameter, four-bladed, turbine impeller. This shear should be similar to that present in the approach system of a modern paper machine.

Suitable flocculants generally have molecular weights in excess of 1,000,000 and often in excess of 5,000,000.

The polymeric flocculant is typically prepared by vinyl addition polymerization of one or more cationic, anionic or nonionic monomers, by copolymerization of one or more cationic monomers with one or more nonionic monomers, by copolymerization of one or more anionic monomers with one or more nonionic monomers, by copolymerization of one or more cationic monomers with one or more anionic monomers and optionally one or more nonionic monomers to produce an amphoteric polymer or by polymerization of one or more zwitterionic monomers and optionally one or more nonionic monomers to form a zwitterionic polymer. One or more zwitterionic monomers and optionally one or more nonionic monomers may also be copolymerized with one or more anionic or cationic monomers to impart cationic or anionic charge to the zwitterionic polymer. Suitable flocculants generally have a charge content of less than 80 mole percent and often less than 40 mole percent.

While cationic polymer flocculants may be formed using cationic monomers, it is also possible to react certain nonionic vinyl addition polymers to produce cationically charged polymers. Polymers of this type include those prepared through the reaction of polyacrylamide with dimethylamine and formaldehyde to produce a Mannich derivative.

Similarly, while anionic polymer flocculants may be formed using anionic monomers, it is also possible to modify certain nonionic vinyl addition polymers to form anionically charged polymers. Polymers of this type include, for example, those prepared by the hydrolysis of polyacrylamide.

The flocculant may be prepared in the solid form, as an aqueous solution, as a water-in-oil emulsion, or as a dispersion in water. Representative cationic polymers include copolymers and terpolymers of (meth)acrylamide with dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate, methyl chloride or benzyl chloride. Representative anionic polymers include copolymers of acrylamide with sodium acrylate and/or 2-acrylamido 2-methylpropane sulfonic acid (AMPS) or an acrylamide homopolymer that has been hydrolyzed to convert a portion of the acrylamide groups to acrylic acid.

In an embodiment, the flocculants have a RSV of at least 3 dL/g.

In an embodiment, the flocculants have a RSV of at least 10 dL/g.

In an embodiment, the flocculants have a RSV of at least 15 dL/g.

As used herein, "RSV" stands for reduced specific viscosity. Within a series of polymer homologs which are substantially linear and well solvated, "reduced specific viscosity (RSV)" measurements for dilute polymer solutions are an indication of polymer chain length and average molecular weight according to *Determination of Molecular Weights*, by Paul J. Flory, pages 266-316, *Principles of Polymer Chemistry*, Cornell University Press, Ithaca, N.Y., Chapter VII (1953). The RSV is measured at a given polymer concentration and temperature and calculated as follows:

$$RSV=[(\eta/\eta_o)-1]/c$$ where $\eta$=viscosity of polymer solution, $\eta_o$=viscosity of solvent at the same temperature and $c$=concentration of polymer in solution.

The units of concentration "c" are (grams/100 ml or g/deciliter). Therefore, the units of RSV are dL/g. Unless otherwise specified, a 1.0 molar sodium nitrate solution is used for measuring RSV. The polymer concentration in this solvent is 0.045 g/dL. The RSV is measured at 30° C. The viscosities $\eta$ and $\eta_o$ are measured using a Cannon Ubbelohde semi-micro dilution viscometer, size 75. The viscometer is mounted in a perfectly vertical position in a constant temperature bath adjusted to 30±0.02° C. The typical error inherent in the calculation of RSV for the polymers described herein is about 0.2 dL/g. When two polymer homologs within a series have similar RSV's that is an indication that they have similar molecular weights.

As discussed above, the first flocculating agent is added in an amount sufficient to mix uniformly in the dispersion without causing significant flocculation of the filler particles. In an embodiment, the first flocculating agent dose is between 0.2 and 6.0 lb/ton of filler treated. In an embodiment, the flocculant dose is between 0.4 and 3.0 lb/ton of filler treated. For purposes of this invention, "lb/ton" is a unit of dosage that means pounds of active polymer (coagulant or flocculant) per 2,000 pounds of filler.

The second flocculating agent can be any material that can initiate the flocculation of filler in the presence of the first flocculating agent. In an embodiment, the second flocculating agent is selected from microparticles, coagulants, flocculants and mixtures thereof.

Suitable coagulants generally have lower molecular weight than flocculants and have a high density of cationic charge groups. The coagulants useful in this invention are well known and commercially available. They may be inorganic or organic. Representative inorganic coagulants include alum, sodium aluminate, polyaluminum chlorides or PACs (which also may be under the names aluminum chlorohydroxide, aluminum hydroxide chloride, and polyaluminum hydroxychloride), sulfated polyaluminum chlorides, polyaluminum silica sulfate, ferric sulfate, ferric chloride, and the like and blends thereof.

Many organic coagulants are formed by condensation polymerization. Examples of polymers of this type include epichlorohydrin-dimethylamine (EPI-DMA) copolymers, and EPI-DMA copolymers crosslinked with ammonia.

Additional coagulants include polymers of ethylene dichloride and ammonia, or ethylene dichloride and dimethylamine, with or without the addition of ammonia, condensation polymers of multifunctional amines such as diethylenetriamine, tetraethylenepentamine, hexamethylenediamine and the like with ethylenedichloride or polyfunctional acids like adipic acid and polymers made by condensation reactions such as melamine formaldehyde resins.

Additional coagulants include cationically charged vinyl addition polymers such as polymers, copolymers, and terpolymers of (meth)acrylamide, diallyl-N,N-disubstituted ammonium halide, dimethylaminoethyl methacrylate and its quaternary ammonium salts, dimethylaminoethyl acrylate and its quaternary ammonium salts, methacrylamidopropyltrimethylammonium chloride, diallylmethyl(beta-propionamido)ammonium chloride, (beta-methacryloyloxyethyl)trimethyl ammonium methylsulfate, quaternized polyvinyllactam, vinylamine, and acrylamide or methacrylamide that has been reacted to produce the Mannich or quaternary Mannich derivatives. Suitable quaternary ammonium salts may be produced using methyl chloride, dimethyl sulfate, or benzyl chloride. The terpolymers may include anionic monomers such as acrylic acid or 2-acrylamido 2-methylpropane sulfonic acid as long as the overall charge on the polymer is cationic. The molecular weights of these polymers, both vinyl addition and condensation, range from as low as several hundred to as high as several million.

Other polymers useful as the second flocculating agent include cationic, anionic, or amphoteric polymers whose chemistry is described above as a flocculant. The distinction between these polymers and flocculants is primarily molecular weight.

The second flocculating agent may be used alone or in combination with one or more additional second flocculating agents. In an embodiment, one or more microparticles are added to the flocculated filler slurry subsequent to addition of the second flocculating agent.

The second flocculating agent is added to the dispersion in an amount sufficient to initiate flocculation of the filler particles in the presence of the first flocculating agent. In an embodiment, the second flocculating agent dose is between 0.2 and 8.0 lb/ton of filler treated. In an embodiment, the second component dose is between 0.5 and 6.0 lb/ton of filler treated.

In an embodiment, one or more microparticles may be added to the flocculated dispersion prior to shearing to provide additional flocculation and/or narrow the particle size distribution.

In an embodiment, the second flocculating agent and first flocculating agent are oppositely charged.

In an embodiment, the first flocculating agent is cationic and the second flocculating agent is anionic.

In an embodiment, the first flocculating agent is selected from copolymers of acrylamide with dimethylaminoethyl methacrylate (DMAEM) or dimethylaminoethyl acrylate (DMAEA) and mixtures thereof.

In an embodiment, the first flocculating agent is an acrylamide and dimethylaminoethyl acrylate (DMAEA) copolymer with a cationic charge content of 5-50 mole % and an RSV of >15 dL/g.

In an embodiment, the second flocculating agent is selected from the group consisting of partially hydrolyzed acrylamide and copolymers of acrylamide and sodium acrylate.

In an embodiment, the second flocculating agent is acrylamide-sodium acrylate copolymer having an anionic charge of 5-40 mole percent and a RSV of 0.3-5 dL/g.

In an embodiment, the first flocculating agent is anionic and the second flocculating agent is cationic.

In an embodiment, the first flocculating agent is selected from the group consisting of partially hydrolyzed acrylamide and copolymers of acrylamide and sodium acrylate.

In an embodiment, the first flocculating agent is a copolymer of acrylamide and sodium acrylate having an anionic charge of 5-75 mole percent and an RSV of at least 15 dL/g.

In an embodiment, the second flocculating agent is selected from the group consisting of epichlorohydrin-dimethylamine (EPI-DMA) copolymers, EPI-DMA copolymers crosslinked with ammonia, and homopolymers of diallyl-N,N-disubstituted ammonium halides.

In an embodiment, the second flocculating agent is a homopolymer of diallyl dimethyl ammonium chloride having an RSV of 0.1-2 dL/g.

In an embodiment, the second flocculating agent is selected from copolymers of acrylamide with dimethylaminoethyl methacrylate (DMAEM) or dimethylaminoethyl acrylate (DMAEA) and mixtures thereof.

In an embodiment, the second flocculating agent is an acrylamide and dimethylaminoethyl acrylate (DMAEA) copolymer with a cationic charge content of 5-50 mole % and an RSV of >15 dL/g.

Dispersions of filler flocs according to this invention are prepared prior to their addition to the papermaking furnish. This can be done in a batch-wise or continuous fashion. The filler concentration in these slurries is typically less than 80% by mass. It is more typically between 5 and 65% by mass.

A batch process can consist of a large mixing tank with an overhead, propeller mixer. The filler slurry is charged to the mix tank, and the desired amount of first flocculating agent is fed to the slurry under continuous mixing. The slurry and flocculant are mixed for an amount of time sufficient to distribute the first flocculating agent uniformly throughout the system, typically for about 10 to 60 seconds, depending on the mixing energy used. The desired amount of second flocculating agent is then added while stirring at a mixing speed sufficient to break down the filler flocs with increasing mixing time typically from several seconds to several minutes, depending on the mixing energy used. Microparticle is added to the filler slurry before, simultaneous to, and/or after adding the first flocculating agent, and prior to the second flocculant agent. Optionally, a microparticle is added after the second flocculating agent. The addition of microparticle increases the shear stability of filler flocs and narrow down the particle size distribution of flocs. When the appropriate size distribution of the filler flocs is obtained, the mixing speed is lowered to a level at which the flocs are stable. This batch of flocculated filler is then transferred to a larger mixing tank with sufficient mixing to keep the filler flocs uniformly suspended in the dispersion. The flocculated filler is pumped from this mixing tank into the papermaking furnish.

In a continuous process the desired amount of first flocculating agent is pumped into the pipe containing the filler and mixed with an in-line static mixer, if necessary. A length of pipe or a mixing vessel sufficient to permit adequate mixing of filler and flocculant may be included prior to the injection of the appropriate amount of second flocculating agent. The second flocculating agent is then pumped into the pipe containing the filler and mixed with an in-line static mixer, if necessary. Microparticle is pumped into the pipe containing the filler slurry and mixed with an in-line static mixer, if necessary. The addition point is before, simultaneous to, and/or after pumping the first flocculating agent, and prior to addition of the second flocculant agent. Optionally, a microparticle is pumped after the second flocculating agent. Addition of microparticle increases the shear stability of filler flocs and narrow down the particle size distribution of flocs. High speed mixing is then required to obtain the desired size distribution of the filler flocs. Adjusting either the shear rate of the mixing device or the mixing time can control the floc size distribution. A continuous process would lend itself to the use of an adjustable shear rate in a fixed volume device. One such device is described in U.S. Pat. No. 4,799,964. This device is an adjustable speed centrifugal pump that, when operated at a back pressure exceeding its shut off pressure, works as a mechanical shearing device with no pumping capacity. Other suitable shearing devices include a nozzle with an adjustable pressure drop, a turbine-type emulsification device, or an adjustable speed, high intensity mixer in a fixed volume vessel. After shearing, the flocculated filler slurry is fed directly into the papermaking furnish.

In both the batch and continuous processes described above, the use of a filter or screen to remove oversize filler flocs can be used. This eliminates potential machine runnability and paper quality problems resulting from the inclusion of large filler flocs in the paper or board.

In an embodiment, the median particle size of the filler flocs is at least 10 μm. In an embodiment, the median particle size of the filler flocs is between 10 and 100 μm. In an embodiment, the median particle size of the filler flocs is between 10 and 70 μm.

In at least one embodiment the invention is practiced using at least one of the compositions and/or methods described in U.S. patent application Ser. No. 12/975,596. In at least one embodiment the invention is practiced using at least one of the compositions and/or methods described in U.S. Pat. No. 8,088,213. In at least one embodiment the invention is practiced using at least one of the compositions and/or methods described in U.S. Pat. No. 8,172,983.

EXAMPLES

The foregoing may be better understood by reference to the following Examples, which are presented for purposes of illustration and are not intended to limit the scope of the invention.

Experimental Methods

In the filler flocculation experiments, the filler slurry was diluted to 10% solids with tap water and 300 mL of this diluted slurry was placed in a 500 mL glass beaker. Stirring was conducted for at least 30 seconds prior to the addition of any chemical additives. The stirrer was an IKA® EURO-STAR Digital overhead mixer with a R1342, 50 mm, four-blade propeller (both available from IKA® Works, Inc., Wilmington, N.C. USA). The final floc size distribution was characterized by laser light scattering using the Malvern Mastersizer Micro from Malvern Instruments Ltd., Southborough, Mass. USA. The analysis was conducted using a polydisperse model and presentation 4PAD. This presentation assumes a 1.60 real component and a 0 imaginary component for the refractive index of the filler and a refractive index of 1.33 for water as the continuous phase. The quality of the distribution was indicated by the volume-weighted median floc size, D(V,0.5) and the span of the distribution, which is defined is $$\text{span} = \frac{D(V, 0.9) - D(V, 0.1)}{D(V, 0.5)}$$

Here D(V,0.1), D(V,0.5), and D(V,0.9) are defined as the diameters that are equal or larger than 10%, 50%, and 90% in volume of filler flocs, respectively. Smaller span values indicate more uniform particle size distributions that are believed to have better performance in papermaking. The values of D(V,0.5) and span for each example were listed in Table I and II.

Example 1

The filler used was scalenohedral, precipitated calcium carbonate (PCC) dry powder (available as Albacar HO from Specialty Minerals Inc., Bethlehem, Pa., USA). This PCC powder was dispersed in tap water at 10% solid. The slurry was stirred under 800 rpm, and a small amount of the sample was taken to measure the particle size distribution using Malvern Mastersizer. The experiments made use of: a) flocculating agent DEV115 (which is a commercially available anionic sodium acrylate-acrylamide copolymer with an RSV of about 32 dL/g and a charge content of 29 mole percent, available from Nalco Company, Naperville, Ill., USA), b) flocculating agent DEV125 (which is a commercially available cationic acrylamide-dimethylaminoethyl acrylate-methyl chloride quaternary salt copolymer with an RSV of about 25 dL/g and a charge content of 10 mole percent, available from Nalco Company, Naperville, Ill., USA.), and c) microparticle Nalco-8699 which is a commercially available colloidal silica dispersion available from Nalco Company, Naperville, Ill., USA.).

The results in Table 1 show that the untreated PCC had a monomodal particle size distribution with a median particle size of 3.75 μm and a span of 1.283. After 30 s mixing of the 10% PCC slurry under 800 rpm, 1.5 lb/ton Nalco DEV115 was added slowly into the slurry using a syringe, followed by slow addition of 1.0 lb/ton Nalco DEV125 using another syringe. After addition of DEV125, one filler sample was taken for particle size measurement (time=0 minutes), then the stirring rate was increased to 1500 rpm and kept for 8 minutes. Samples were taken in every two minutes interval to measure the particle size distribution (time=2, 4, 6 and 8 minutes). This shearing was done for the purpose of evaluating the stability of the filler flocs. The results are shown in Table 1.

Example 2

Experiment 1 was repeated with microparticle as one of the component in the treatment program. 0.5 lb/ton Nalco-8699 was added before the addition of DEV115.

Example 3

Experiment 1 was repeated with microparticle as one of the component in the treatment program. 1.0 lb/ton Nalco-8699 was added before the addition of DEV115.

Example 4

Experiment 1 was repeated with microparticle as one of the component in the treatment program. 1.5 lb/ton Nalco-8699 was added before the addition of DEV115.

Example 5

Experiment 1 was repeated with microparticle as one of the component in the treatment program. 1.0 lb/ton Nalco-8699 was added after the addition of DEV115 but before DEV125.

Example 6

Experiment 1 was repeated with microparticle as one of the component in the treatment program. 1.0 lb/ton Nalco-8699 was added after the addition of DEV125.

Example 7

Experiment 1 was repeated with microparticle as one of the component in the treatment program. 1.0 lb/ton Nalco-8699 and 1.5 lb/ton DEV115 were premixed before adding into the filler slurry, followed by the addition of DEV125.

TABLE I

The particle size distribution characteristics of PCC (precipitated calcium carbonate) flocs formed by different chemical programs and sheared under 1500 rpm for various times.

| Experiment | time (min) | span | D(v, 0.1) (μm) | D(v, 0.5) (μm) | D(v, 0.9) (μm) |
|---|---|---|---|---|---|
| PCC, untreated | 0 | 1.283 | 1.97 | 3.75 | 6.78 |
| 1 | 0 | 0.916 | 95.26 | 188.13 | 267.59 |
| | 2 | 1.803 | 21.26 | 58.14 | 126.06 |
| | 4 | 1.849 | 14.94 | 41.5 | 91.69 |
| | 6 | 1.882 | 12.49 | 34.76 | 77.91 |
| | 8 | 1.890 | 11.08 | 30.71 | 69.12 |
| 2 | 0 | 0.946 | 92.69 | 169.24 | 252.87 |
| | 2 | 1.617 | 24.7 | 57.99 | 118.49 |
| | 4 | 1.655 | 17.91 | 41.92 | 87.29 |
| | 6 | 1.688 | 14.9 | 34.64 | 73.36 |
| | 8 | 1.695 | 13.06 | 30.36 | 64.53 |
| 3 | 0 | 0.837 | 104.51 | 197.7 | 269.9 |
| | 2 | 1.663 | 27.74 | 66.15 | 137.74 |
| | 4 | 1.678 | 19.69 | 46.96 | 98.49 |
| | 6 | 1.693 | 16.42 | 38.98 | 82.43 |
| | 8 | 1.694 | 14.55 | 34.39 | 72.8 |
| 4 | 0 | 0.831 | 102.98 | 196.94 | 266.56 |
| | 2 | 1.758 | 30.99 | 86.86 | 183.69 |
| | 4 | 1.944 | 20.1 | 59.87 | 136.48 |
| | 6 | 1.942 | 15.77 | 48.19 | 109.36 |
| | 8 | 1.974 | 14.01 | 42.6 | 98.1 |

TABLE I-continued

The particle size distribution characteristics of PCC (precipitated calcium carbonate) flocs formed by different chemical programs and sheared under 1500 rpm for various times.

| Experiment | time (min) | span | D(v, 0.1) (μm) | D(v, 0.5) (μm) | D(v, 0.9) (μm) |
|---|---|---|---|---|---|
| 5 | 0 | 0.995 | 82.66 | 163.61 | 245.52 |
| | 2 | 1.808 | 22.98 | 60.79 | 132.91 |
| | 4 | 1.838 | 16.45 | 43.4 | 96.2 |
| | 6 | 1.862 | 13.71 | 35.96 | 80.65 |
| | 8 | 1.859 | 12.23 | 31.73 | 71.22 |
| 6 | 0 | 0.748 | 119.7 | 216.05 | 281.41 |
| | 2 | 1.824 | 28.38 | 77.75 | 170.22 |
| | 4 | 1.863 | 18.62 | 51.98 | 115.44 |
| | 6 | 1.863 | 15.4 | 42.34 | 94.27 |
| | 8 | 1.834 | 13.68 | 37.07 | 81.65 |
| 7 | 0 | 0.855 | 102.72 | 196.83 | 270.95 |
| | 2 | 1.815 | 27.65 | 71.58 | 157.55 |
| | 4 | 1.806 | 17.97 | 48.93 | 106.34 |
| | 6 | 1.823 | 15.6 | 40.28 | 89.04 |
| | 8 | 1.823 | 13.91 | 35.53 | 78.69 |

The results in Table I show that with Nalco-8699 microparticle in the flocculation program, no matter if it is added before the anionic flocculating agent, after anionic flocculating agent, pre-mixed with anionic flocculating agent or after cationic flocculating agent, both filler flocculation and shear stability of the resulted filler flocs improved significantly.

Example 8

The filler used was ground calcium carbonate (GCC) slurry as 70% solids. This slurry was diluted to 10% solids with tap water. The slurry was stirred under 800 rpm, and a small amount of the sample was taken to measure the particle size distribution using Malvern Mastersizer. The results in Table II show that the untreated GCC had a monomodal particle size distribution with a median particle size of 1.51 μm and a span of 2.029.

After 30 s mixing of the 10% GCC slurry under 800 rpm, 1.5 lb/ton Nalco DEV120 was added to the slurry, followed by slow addition of 0.75 lb/ton Nalco DEV115 into the slurry using a syringe, and finally slow addition of 0.60 lb/ton Nalco DEV125 using another syringe. After addition of DEV125, one filler sample was taken for particle size measurement (time=0 minutes), then the stirring rate was increased to 1500 rpm and kept for 8 minutes. Samples were taken in every two minutes interval to measure the particle size distribution (time=2, 4, 6 and 8 minutes). The results were shown in Table II.

Example 9

Experiment 8 was repeated with microparticle as one of the component in the treatment program. 0.5 lb/ton Nalco-8699 was added before the addition of DEV115.

Example 10

Experiment 8 was repeated with microparticle as one of the component in the treatment program. 1.0 lb/ton Nalco-8699 was added before the addition of DEV115.

Example 11

Experiment 8 was repeated with microparticle as one of the component in the treatment program. 1.0 lb/ton Nalco-8699 was added after the addition of DEV115 but before DEV125.

Example 12

Experiment 8 was repeated with microparticle as one of the component in the treatment program. 1.0 lb/ton Nalco-8699 was added after the addition of DEV125.

Example 13

Experiment 8 was repeated with microparticle as one of the component in the treatment program. 1.0 lb/ton Nalco-8699 and 0.75 lb/ton DEV115 were premixed before adding into the filler slurry, followed by the addition of DEV125.

TABLE II

The particle size distribution characteristics of GCC (ground calcium carbonate) flocs formed by different chemical programs and sheared under 1500 rpm for various times.

| Experiment | time (min) | span | D(v, 0.1) (μm) | D(v, 0.5) (μm) | D(v, 0.9) (μm) |
|---|---|---|---|---|---|
| GCC, untreated | 0 | 2.029 | 0.59 | 1.51 | 3.66 |
| 8 | 0 | 1.421 | 49.54 | 117.71 | 216.78 |
| | 2 | 1.851 | 23.36 | 59.89 | 134.24 |
| | 4 | 1.903 | 17.45 | 45.71 | 104.43 |
| | 6 | 1.983 | 14.70 | 38.82 | 91.68 |
| | 8 | 2.066 | 13.03 | 34.67 | 84.69 |
| 9 | 0 | 1.194 | 66.24 | 141.62 | 235.37 |
| | 2 | 1.862 | 27.07 | 70.07 | 157.53 |
| | 4 | 1.994 | 19.23 | 51.69 | 122.29 |
| | 6 | 2.039 | 15.43 | 42.88 | 102.85 |
| | 8 | 2.086 | 13.33 | 37.92 | 92.41 |
| 10 | 0 | 9.935 | 84.92 | 169.81 | 253.62 |
| | 2 | 1.87 | 28.30 | 78.39 | 174.88 |
| | 4 | 2.104 | 18.56 | 57.97 | 140.51 |
| | 6 | 2.208 | 14.50 | 47.87 | 120.18 |
| | 8 | 2.272 | 12.04 | 41.38 | 106.04 |
| 11 | 0 | 1.003 | 84.93 | 167.75 | 253.25 |
| | 2 | 1.802 | 30.94 | 79.63 | 174.45 |
| | 4 | 1.847 | 23.18 | 59.74 | 133.54 |
| | 6 | 1.911 | 19.82 | 51.16 | 117.78 |
| | 8 | 1.874 | 17.61 | 45.47 | 102.84 |
| 12 | 0 | 1.09 | 77.99 | 143.99 | 234.88 |
| | 2 | 1.385 | 53.53 | 114.17 | 211.62 |
| | 4 | 1.612 | 38.48 | 94.83 | 191.38 |
| | 6 | 1.728 | 29.81 | 82.46 | 172.33 |
| | 8 | 1.864 | 24.06 | 74.69 | 163.22 |
| 13 | 0 | 7.599 | 116.61 | 218.64 | 218.24 |
| | 2 | 1.558 | 40.47 | 112.51 | 215.72 |
| | 4 | 1.899 | 25.81 | 83.24 | 183.87 |
| | 6 | 2.06 | 19.94 | 68.76 | 161.58 |
| | 8 | 2.12 | 16.97 | 60.81 | 145.90 |

The results in Table II show that with Nalco-8699 microparticle in the flocculation program, no matter if it is added before the anionic flocculating agent, after anionic flocculating agent, pre-mixed with anionic flocculating agent or after cationic flocculating agent, both filler flocculation and shear stability of the resulted filler flocs improved significantly.

While this invention may be embodied in many different forms, there described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and/or incorporated herein. In addition the invention encompasses any possible combination that also specifically excludes any one or some of the various embodiments described herein and/or incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range. All percentages and ratios are by weight unless otherwise stated.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method of preparing a stable dispersion of flocculated filler particles having a specific particle size distribution for use in papermaking processes comprising:

a) providing an aqueous dispersion of filler particles;

b) adding a first flocculating agent to the dispersion in an amount sufficient to mix uniformly in the dispersion without causing significant flocculation of the filler particles, and the first flocculating agent being amphoteric and has a net charge;

c) adding a microparticle to the dispersion in an amount insufficient cause significant flocculation of the filler particles before, simultaneous to, and/or after adding the first flocculating agent, and prior to adding a second flocculating agent;

d) adding the second flocculating agent to the dispersion in an amount sufficient to initiate flocculation of the filler particles in the presence of the first flocculating agent wherein the second flocculating agent has opposite charge to the net charge of the first amphoteric flocculating agent;

e) shearing the flocculated dispersion to provide a dispersion of filler flocs having the desired particle size; and f) flocculating the filler particles prior to adding them to a paper stock and wherein no paper stock is present during the flocculation;

wherein the filler is anionically dispersed and a low molecular weight, cationic coagulant is added to the dispersion to at least partially neutralize its anionic charge prior to the addition of the first flocculating agent or microparticle.

2. The method of claim 1 wherein the filler flocs have a median particle size of 10-100 μm.

3. The method of claim 1 wherein the filler is selected from the group consisting of precipitated calcium carbonate, ground calcium carbonate, kaolin clay, talc, titanium dioxide, alumina trihydrate, barium sulfate and magnesium hydroxide, and mixtures thereof.

4. The method of claim 1 wherein the first flocculating agent has net anionic charge.

5. The method of claim 4 wherein the second flocculating agent is cationic, selected from the group consisting of copolymers and terpolymers of (meth) acrylamide with dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate, methyl chloride or benzyl chloride, and mixtures thereof.

6. The method of claim 5 wherein the second flocculating agent is acrylamide-dimethylaminoethyl acrylate methyl chloride quaternary copolymer having a cationic charge of 10-50 mole percent and a RSV of at least 15 dL/g.

7. The method of claim 4 wherein the second flocculating agent is a homopolymer of diallyl dimethyl ammonium chloride having an RSV of 0.1-2 dL/g.

8. A method of preparing a stable dispersion of flocculated filler particles having a specific particle size distribution for use in papermaking processes comprising:

a) providing an aqueous dispersion of filler particles;

b) adding a first flocculating agent to the dispersion in an amount sufficient to mix uniformly in the dispersion without causing significant flocculation of the filler particles, and the first flocculating agent being amphoteric and has a net charge;

c) adding a microparticle to the dispersion in an amount insufficient cause significant flocculation of the filler particles before, simultaneous to, and/or after adding the first flocculating agent, and prior to adding a second flocculating agent;

d) adding the second flocculating agent to the dispersion in an amount sufficient to initiate flocculation of the filler particles in the presence of the first flocculating agent wherein the second flocculating agent has opposite charge to the net charge of the first amphoteric flocculating agent;

e) adding one or more microparticles to the flocculated dispersion after addition of the second flocculating agent;

f) shearing the flocculated dispersion to provide a dispersion of filler flocs having the desired particle size; and g) flocculating the filler particles prior to adding them to a paper stock and wherein no paper stock is present during the flocculation;

wherein the filler is anionically dispersed and a low molecular weight, cationic coagulant is added to the dispersion to at least partially neutralize its anionic charge prior to the addition of the first flocculating agent or microparticle.

9. A method of preparing a stable dispersion of flocculated filler particles having a specific particle size distribution for use in papermaking processes comprising:

a) providing an aqueous dispersion of filler particles;

b) adding a first flocculating agent to the dispersion in an amount sufficient to mix uniformly in the dispersion without causing significant flocculation of the filler particles, and the first flocculating agent being amphoteric and has a net charge;

c) adding a microparticle to the dispersion in an amount insufficient cause significant flocculation of the filler particles before, simultaneous to, and/or after adding the first flocculating agent, and prior to adding a second flocculating agent;

d) adding the second flocculating agent to the dispersion in an amount sufficient to initiate flocculation of the filler particles in the presence of the first flocculating agent wherein the second flocculating agent has opposite charge to the net charge of the first amphoteric flocculating agent;

e) adding a swollen starch to dispersion of filler particles;

f) shearing the flocculated dispersion to provide a dispersion of filler flocs having the desired particle size; and g) flocculating the filler particles prior to adding them to a paper stock and wherein no paper stock is present during the flocculation.

10. The method of claim 9 wherein the swollen starch is added before, and/or after adding the first flocculating agent, and prior to adding a second flocculating agent.

11. The method of claim 9 wherein the swollen starch is cationic, anionic, amphoteric or noionic.

12. The method of claim 9 wherein the swollen starch is a swollen-starch-latex composition.

13. The method of claim 1 in which the microparticle is one selected from the list consisting of: siliceous materials, silica based particles, silica microgels, colloidal silica, silica sols, silica gels, polysilicates, cationic silica, aluminosilicates, polyaluminosilicates, borosilicates, polyborosilicates, zeolites, and synthetic or naturally occurring swelling clays, anionic polymeric microparticles, cationic polymeric microparticles, amphoteric organic polymeric microparticles, and any combination thereof.

* * * * *